US011953197B2

(12) United States Patent
Spears

(10) Patent No.: US 11,953,197 B2
(45) Date of Patent: Apr. 9, 2024

(54) HIGH-PRESSURE INSTANT STEAM GENERATOR

(71) Applicant: Patrick Spears, Brentwood, CA (US)

(72) Inventor: Patrick Spears, Brentwood, CA (US)

(73) Assignee: CleanNesta LLC

( * ) Notice: Subject to any disclaimer, the term of this patent is extended or adjusted under 35 U.S.C. 154(b) by 418 days.

(21) Appl. No.: 17/210,513

(22) Filed: Mar. 24, 2021

(65) Prior Publication Data

US 2021/0207797 A1 Jul. 8, 2021

(51) Int. Cl.

| | |
|---|---|
| ***F22G 5/14*** | (2006.01) |
| ***F22B 1/28*** | (2006.01) |
| ***F22B 27/08*** | (2006.01) |
| ***F22B 27/16*** | (2006.01) |
| ***F22B 35/00*** | (2006.01) |
| ***F22B 35/12*** | (2006.01) |
| ***F22B 35/18*** | (2006.01) |
| ***F22G 1/16*** | (2006.01) |

(Continued)

(52) U.S. Cl.

CPC ..... *F22G 1/165* (2013.01); *F22B 1/282* (2013.01); *F22B 1/287* (2013.01); *F22B 1/288* (2013.01); *F22B 27/08* (2013.01); *F22B 27/16* (2013.01); *F22B 35/005* (2013.01); *F22B 35/12* (2013.01); *F22G 3/009* (2013.01); *F22G 5/00* (2013.01)

(58) Field of Classification Search

CPC . F22G 1/165; F22G 3/009; F22G 5/00; F22G 1/005; F22G 5/12; F22G 5/14; F22B 1/282; F22B 1/287; F22B 1/288; F22B 27/00; F22B 27/08; F22B 27/16; F22B 35/005; F22B 35/12; F22B 35/18

See application file for complete search history.

(56) References Cited

U.S. PATENT DOCUMENTS 2,481,760 A * 9/1949 Leher ..... F22G 1/165 15/93.1
3,915,124 A * 10/1975 Kuhn, Jr. ..... F22B 25/00 122/501

(Continued)

FOREIGN PATENT DOCUMENTS

CN 215052608 U * 12/2021
WO WO-2007049131 A2 * 5/2007

(Continued)

*Primary Examiner* — Gregory A Wilson

(57) ABSTRACT

A high-pressure instant steam generator is disclosed. The steam generator unit comprises a HP unit, a HP water-band heater, an evaporator, a super heater, and at least a spray gun attachment. The high-pressure unit comprises a main pump for supplying a liquid from a storage tank in case of independent unit. The HP water band heater connected to the HP unit via a needle valve and a first manifold. The evaporator connected to the band heater via a second manifold and a check-valve, configured to convert the liquid into steam at a saturation point. The super heater connected to the evaporator via a check-valve, configured to heat the generated steam to the saturated temperature. The high-pressure steam attachment or spray gun connected to the super heater via a fourth manifold, configured to spray the generated high-pressure steam for sanitizing the surface the surface of the object being treated.

20 Claims, 20 Drawing Sheets

(51) Int. Cl.
*F22G 3/00* (2006.01)
*F22G 5/00* (2006.01)

(56) References Cited

U.S. PATENT DOCUMENTS

| | | | | |
|---|---|---|---|---|
| 6,647,204 | B1 * | 11/2003 | Hutchinson | A47L 11/4088 392/491 |
| 6,925,968 | B1 * | 8/2005 | Hwang | F22B 13/00 122/DIG. 10 |
| 2007/0122127 | A1 * | 5/2007 | Friedheim | F22B 1/287 392/401 |
| 2012/0039586 | A1 * | 2/2012 | Collinson | D06F 75/14 392/404 |
| 2021/0052754 | A1 * | 2/2021 | Hilaire | B08B 3/028 |

FOREIGN PATENT DOCUMENTS

| | | | |
|---|---|---|---|
| WO | WO-2013105990 | A2 * | 7/2013 |
| WO | WO-2014039296 | A1 * | 3/2014 |

* cited by examiner

HIGH-PRESSURE INSTANT STEAM GENERATOR

BACKGROUND OF THE INNOVATION

A. Technical Field

The invention disclosed herein generally relates to a high-pressure instant steam generator. More particularly, the present invention relates to a steam generator unit for instantaneously generating high pressure steam at high temperatures for use in a plurality of use cases, which may include for example cleaning applications.

B. Description of Related Art

Conventional cleaning devices such as steam cleaners for example, typically make use of a boiler to generate and provide steam for use in a cleaning application. Although the use of a boiler in conventional steam cleaners is able to provide adequate amounts of steam for use in the removal surface-level containments, they are often bulky in size and heavy in weight, which makes them unsuitable for ultra-portable use-cases where equipment has to be frequently moved or carried for an extended period of time. Furthermore, the usage of boilers in conventional steam cleaners for example, often heat large volumes of cold water to produce adequate amounts of steam for use in a cleaning application. The heating of large amounts of water produces a built-in and required delay before the cold water can be heated to sufficient temperature levels suitable to produce steam for use in the removal of surface-level containments.

Few existing patent references attempted to address the aforementioned problems are cited in the background as prior art over the presently disclosed subject matter and are explained as follows:

A prior art CN2617638Y assigned to Liu Yupu, describes about a high-pressure saturated steam and water apparatus for washing vehicle which includes an outer shell, a generator gun apparatus, a water tank and a high-pressure electric pump that is connected with the water tank. A temperature controller is connected with a gas-accumulating tank by a temperature sensor. A generator gun device is a generator gun handle which is provided with an electric contact remote control group and switch. It is used to clean the surface of the vehicle and provided with an evaporator. The evaporator begins heating, and produces steam. A generator gun device and water tank assembly arranged in the shell with high pressure electric pump connected to motors, steam pipe, wherein the generator gun has a heat-insulation layer and the water course of injection is finished in the water nozzle ejection that high pressure water is extracted by generator gun through adjustable flow distributing valve, water connection, hydraulic pipeline, lance duct. When pressing electric contact remote control group and switch, connecting the two-position three-way magnetic valve that is located on the water passage. The gas-accumulating tank is connected with evaporator, wherein the evaporator is connected with the high-pressure electric pump. A temperature controller and temperature sensor are connected with the gas-accumulating tank.

Another prior art U.S. Pat. No. 7,895,705B2 assigned to Kim Tae-Young describes about a steam cleaning apparatus which includes water and wax containers to supply water and wax. A nozzle is used to generate the mixture into a pipe of a pipe coil, a combustion chamber with the pipe coil to receive and to heat the generated mixture, a burner is used to heat the pipe coil of the combustion chamber with a fuel from a fuel container to convert the generated mixture into steam which has high temperature and high pressure and a steam gun which is used to discharge the high temperature and pressure steam from the combustion chamber to an outside of the apparatus. An automatic controller is used to control power supply into the apparatus. The hydraulic pressure switch includes a pressure sensor and sends the measurement result to the controller and water mixture is discharged through the mixture discharge port of the pump.

However, the existing patent CN2617638Y fails to disclose that the high-pressure saturated steam and water apparatus having a high-pressure pumping assembly to produce high pressure water that is a micro pump with motor assembly. Further, the existing patent U.S. Pat. No. 7,895,705B2 fails to disclose that the steam cleaning apparatus has its own microprocessor unit, so it could not enable to initiate the sequence of programmed operation.

Therefore, there is a need for a high-pressure instant steam generator configured to instantaneously generate high pressure steam at high temperature to remove surface-level containments. There is also a need for a high temperature steam generator unit, which is provided with a super heater that includes band heaters for raising the temperature of steam from saturation point to above saturation point. Further, there is also a need for a high temperature steam generator unit that is provided with at least a spray gun attachment having a valve, which allows steam to pass through a spring adjust washer, wherein the spring adjust washer comprises slots on its periphery, wherein the steam passes through annular holes in the nozzle housing on its face.

SUMMARY OF THE INNOVATION

The present invention discloses a high-pressure instant steam generator configured to instantaneously generate high pressure steam at high temperature to for example, remove surface-level containments. In one embodiment, the generator unit acts a dependent system. In one embodiment, the generator unit comprises a plurality of components include, but not limited to, a high-pressure unit, a high-pressure water band heater, an evaporator, a super heater, and at least generator gun attachment. In one embodiment, the high-pressure unit comprises a main pump for supplying a liquid from a storage tank at high pressure via at least one pressure relief valve, a flow regulator, and a diverter. The high-pressure water band heater fluidly connected to the high-pressure unit via a needle valve and a first manifold through a channel, configured to heat the liquid supplied from the high-pressure unit. In one embodiment, the evaporator fluidly connected to the high-pressure water band heater via a second manifold and an inlet check valve through the channel, wherein the evaporator is configured to convert the liquid received from the high-pressure water band heater into steam at a saturation point. In one embodiment, the super heater fluidly connected to the evaporator via an outlet check valve and a third manifold through the channel, wherein the super heater is configured to heat the generated steam to the saturated temperature. In one embodiment, the generator gun fluidly connected to the super heater via a fourth manifold through the channel, wherein at least the generator gun attachment is configured to enable the user to conveniently generate the generated high-pressure steam on the surfaces of the object, thereby effectively removing contaminant particles on their surfaces.

In one embodiment, the high-pressure water band heater further comprises a hollow section, one or more helical coils or tubes disposed within the hollow section, wherein the helical coils are configured to allow high pressure water, a heater configured to radiate on the helical coils through which liquid flows for heating the liquid, and a thermostat configured to protect the heater from damages by switching off when the temperature reaches its maximum allowable limit.

In one embodiment, the helical tubes are made of a material includes copper, steel, and aluminum. In one embodiment, the high-pressure water band heater length is selected depending on the heat required to raise the temperature water entering the heater to the saturations point at the pressure at which water enters the heater. In one embodiment, the needle valve is configured to control the liquid flow.

In one embodiment, the first manifold is configured to receive at least one first pressure sensor. The first pressure sensor is configured to measure the pressure of the liquid and generate a current/voltage signal, which will send to the main control panel or a micro processing unit for further programming. In one embodiment, the second manifold is configured to receive at least one hot water pressure sensor and a temperature sensor. The hot water pressure sensor is configured to measure pressure of the liquid flow and the temperature sensor is configured to measure the temperature of the liquid.

In one embodiment, the third manifold is configured to receive at least one steam pressure sensor and a steam temperature sensor. The steam pressure sensor is configured to measure pressure of the steam and the steam temperature sensor is configured to measure the temperature of the steam. In one embodiment, the fourth manifold is configured to receive at least one super heat steam pressure sensor and a super heat temperature sensor. The super heat steam pressure sensor is configured to measure the pressure of the generated steam and the super heat temperature sensor is configured to measure the temperature of the generated steam.

In one embodiment, the evaporator further comprises an evaporator chamber or a doubled walled vessel having an inner housing and an outer housing. The inner housing comprises at least three orifices, which are configured to force the liquid to the annular space between inner and outer vessel at a high velocity and causes the liquid to atomize thus the evaporation of the water is faster and at a higher efficiency.

In another embodiment, the generator unit acts as an independent system. In one embodiment, the generator unit as an independent system comprises a micro pump with a motor assembly for supplying a liquid from a storage tank at high pressure. In one embodiment, the storage tank comprises a level switch, a filter low level indicator, and an over flow pipe. In one embodiment, a high-pressure water band heater fluidly connected to the micro pump with a motor assembly via a needle valve and a first manifold through a channel. The high-pressure water band heater configured to heat the liquid supplied from the high-pressure unit, wherein the needle valve is configured to control the liquid flow. In one embodiment, an evaporator fluidly connected to the high-pressure water band heater via a second manifold and an inlet check valve through the channel. The evaporator is configured to convert the liquid received from the high-pressure water band heater into steam at a saturation point.

In one embodiment, a super heater fluidly connected to the evaporator via an outlet check valve and a third manifold through the channel. The super heater is configured to heat the generated steam to the saturated temperature. In one embodiment, a generator gun fluidly connected to the super heater via a fourth manifold through the channel. The generator gun is configured to enable the user to conveniently generate the generated high-pressure steam on the surfaces of the object, thereby effectively removing contaminant particles on their surfaces.

In one embodiment, the dependent cleaning system: In the combined cleaning system as in, (refer PID diagram, FIG. 20) high pressure water of a minimum flow of 0.1 GMP, enters the needle valve from the diverter valve (when opened) of high-pressure washing system. Now onwards in this document we refer to as HPW. The HPW, we referring here is the system, which has main console to produce high pressure steam, variable flow (0.1 GPM to 1 GPM), Liquid chemical cleaning system, and an air cleaning system, both pressure and vacuum. Here the dependent cleaning system, which is the sub-assembly of the High-pressure washing system. In short, the complete HPW, comprises of liquid chemical cleaning, Steam cleaning and air cleaning. Once water enters to needle valve, the flow is further controlled to 30 CC/minute or variable lesser than 30 cc/min. The water flows through the first band heater, to raise temperature to saturation point at that pressure (i.e., 150 psi/200 psi). At this point it is necessary to mention that the required pressure is controlled in the High-pressure washing system. There is not separate pressure control valve here. In the next stage saturated water enters to the evaporator where it is converted to steam at that pressure. That is only latent heat is added. Evaporator is heated by band heater. Then saturated enters the super heater where is temperature is raised to 200 to 250 Deg C. before entering the spray Nozzle. It may be note, water/steam path is not reversible, which means there is no back flow. The entire water path and steam path are equipped with pressure and temperature sensors.

Other objects, features and advantages of the present innovation will become apparent from the following detailed description. It should be understood, however, that the detailed description and the specific examples, while indicating specific embodiments of the innovation, are given by way of illustration only, since various changes and modifications within the spirit and scope of the innovation will become apparent to those skilled in the art from this detailed description.

BRIEF DESCRIPTION OF DRAWINGS

The foregoing summary, as well as the following detailed description of the innovation, is better understood when read in conjunction with the appended drawings. For the purpose of illustrating the innovation, exemplary constructions of the innovation are shown in the drawings. However, the innovation is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present innovation will now be given with reference to the Figures. It is expected that the present innovation may be embodied in other specific forms without departing from its spirit or essential characteristics. The described embodiments are to be considered in all respects only as illustrative and not restrictive.

Figure 1:
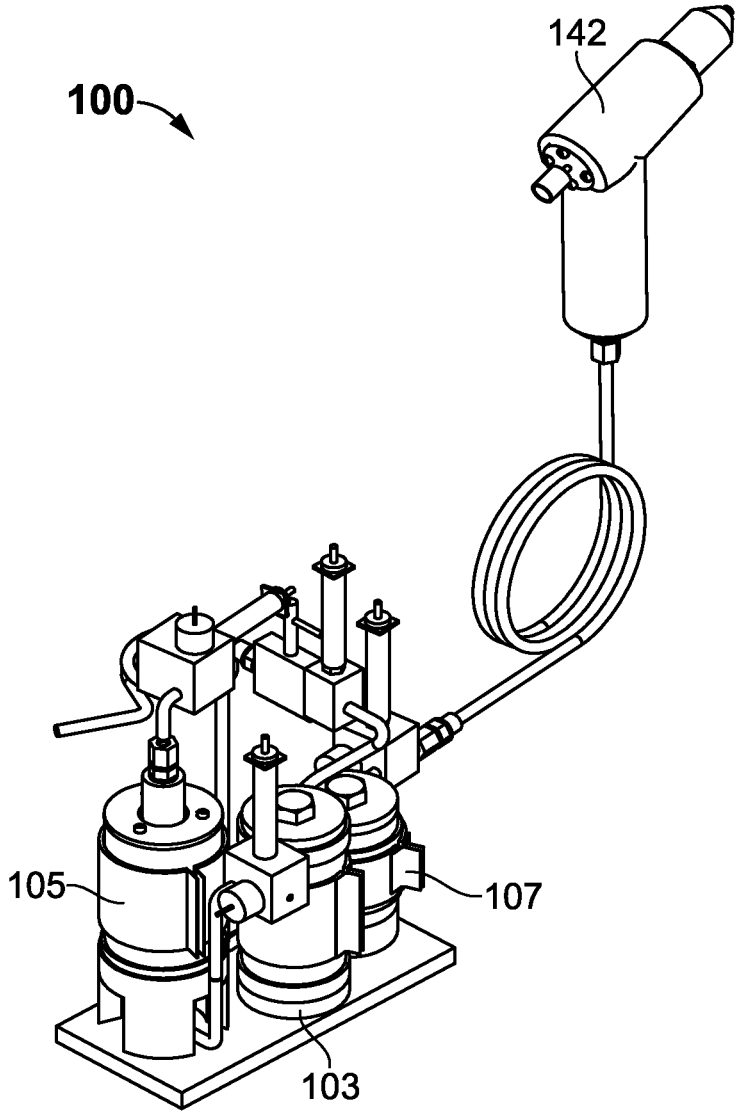
FIG. 1 exemplarily illustrates a perspective view of a high-pressure instant steam generator, which acts as a dependent system, according to an embodiment of the present invention.
Figure 2:
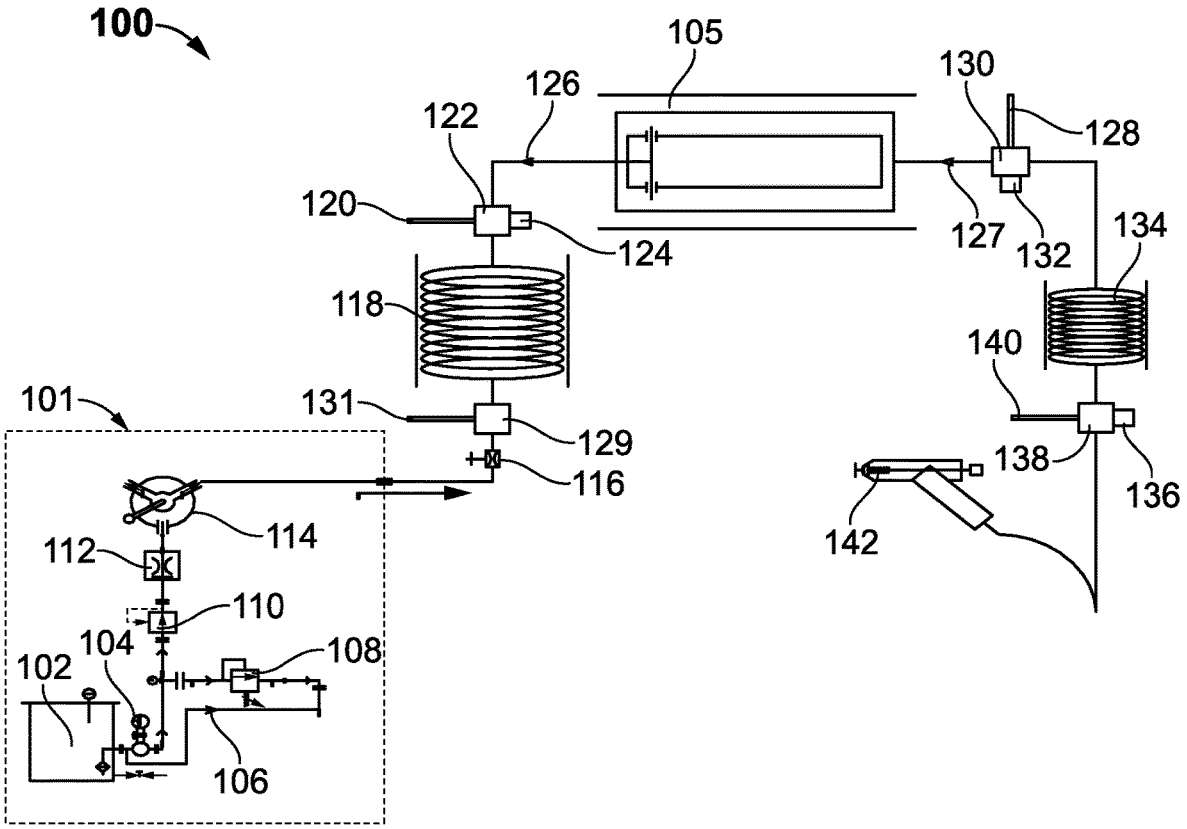
FIG. 2 exemplarily illustrates a block diagram of the high-pressure instant steam generator (dependent system), according to an embodiment of the present invention.
Figure 3:
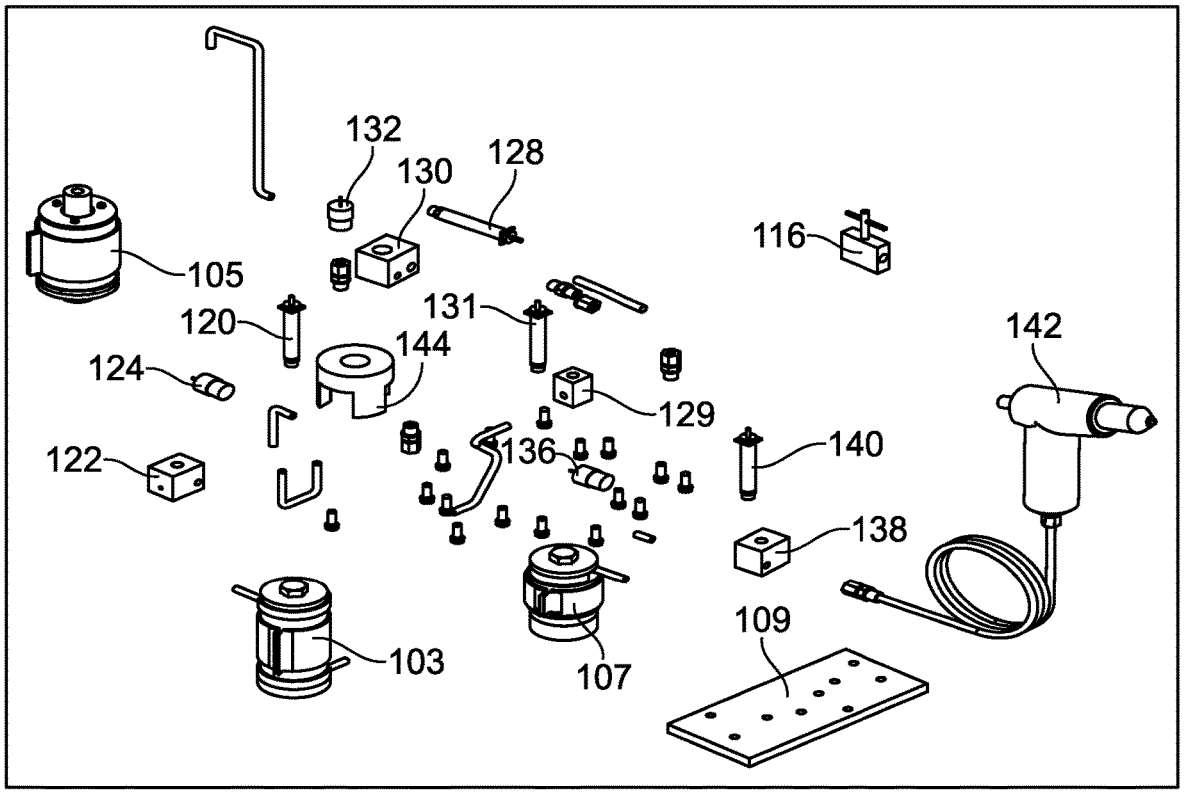
FIG. 3 exemplarily illustrates an exploded view of the high-pressure instant steam generator, according to one embodiment of the present invention.
Figure 4:
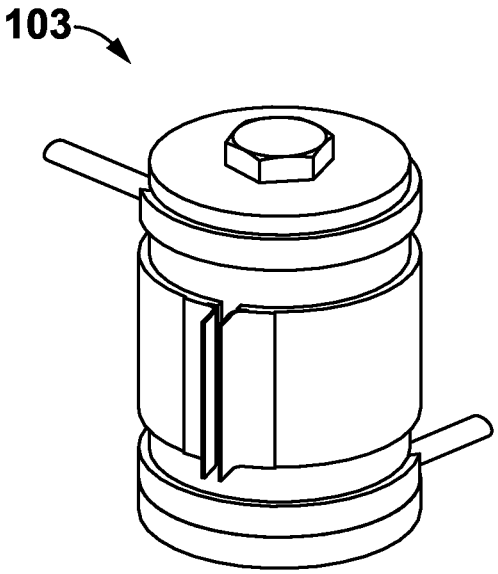
FIG. 4 exemplarily illustrates an isometric view of a high-pressure water band heater of the high-pressure instant steam generator, according to one embodiment of the present invention.
Figure 5:
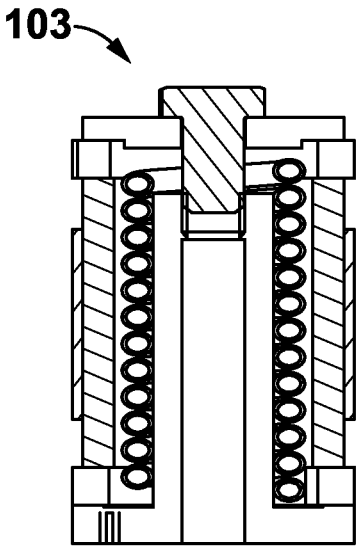
FIG. 5 exemplarily illustrates a sectional view of the high-pressure water band heater, according to one embodiment of the present invention.
Figure 6:
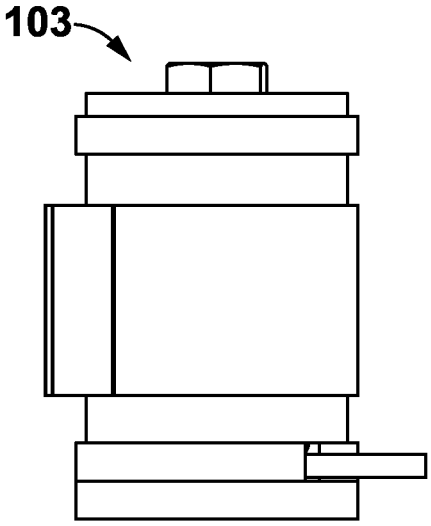
FIG. 6 exemplarily illustrates a front view of the high-pressure water band heater, according to one embodiment of the present invention.
Figure 7:
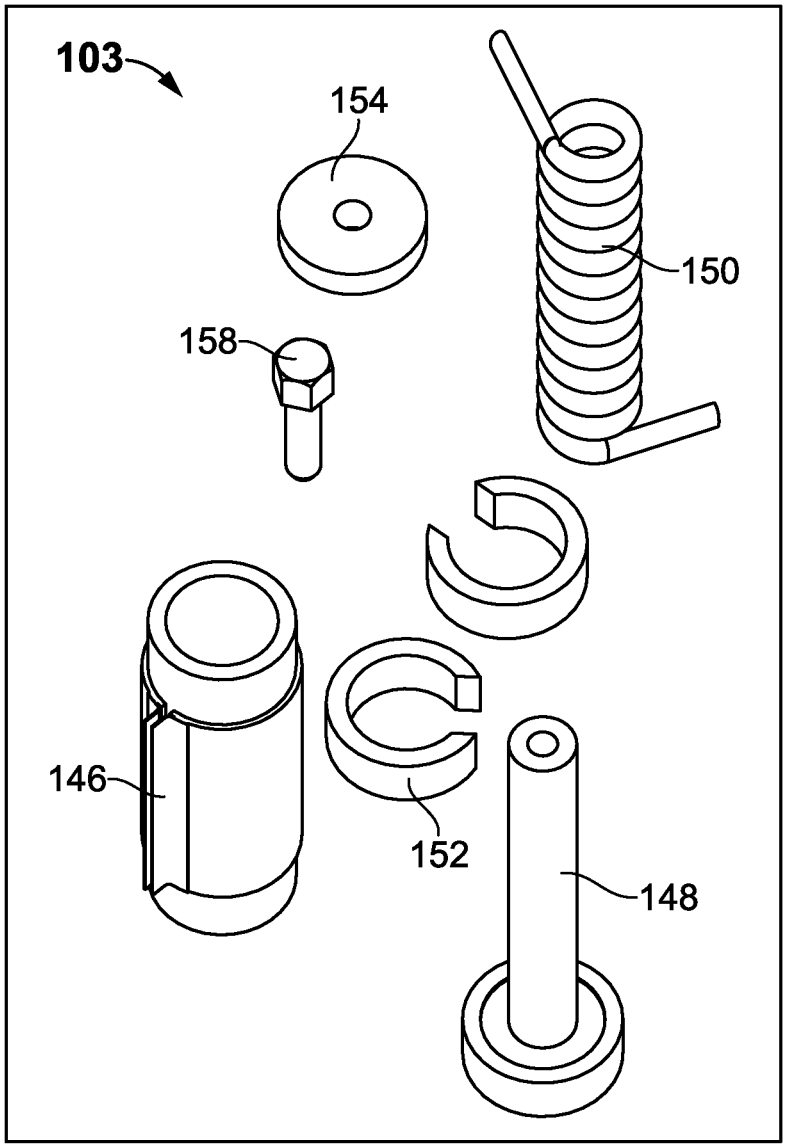
FIG. 7 exemplarily illustrates an exploded view of the high-pressure water band heater, according to one embodiment of the present invention.
Figure 8:
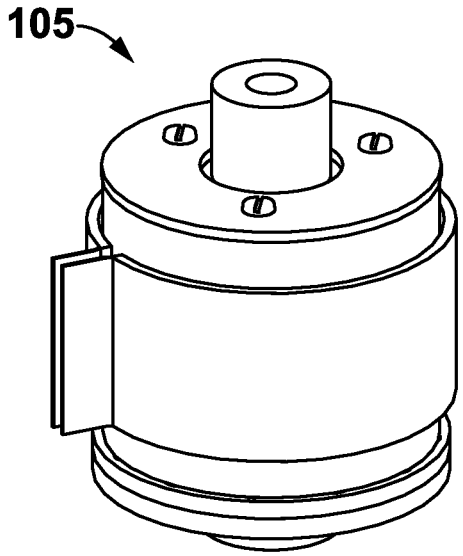
FIG. 8 exemplarily illustrates an isometric view of an evaporator of the high-pressure instant steam generator, according to one embodiment of the present invention.
Figure 9:
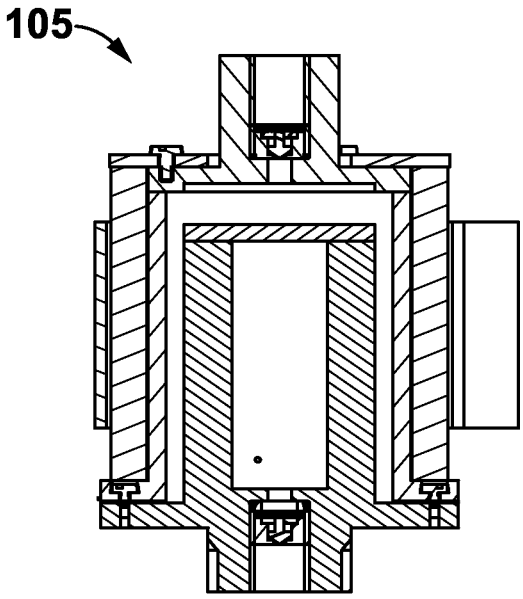
FIG. 9 exemplarily illustrates a sectional view of the evaporator, according to one embodiment of the present invention.
Figure 10:
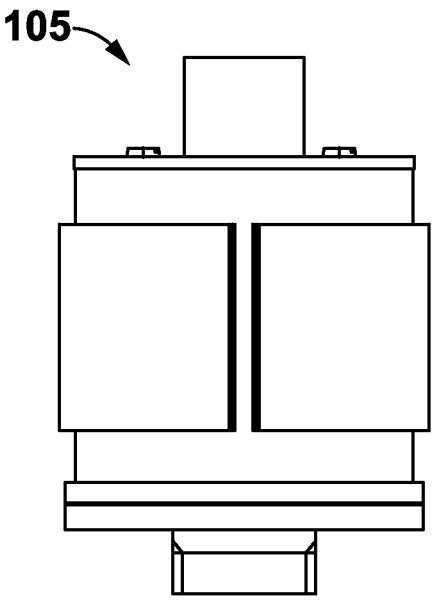
FIG. 10 exemplarily illustrates a front view of the evaporator according to one embodiment of the present invention.
Figure 11:
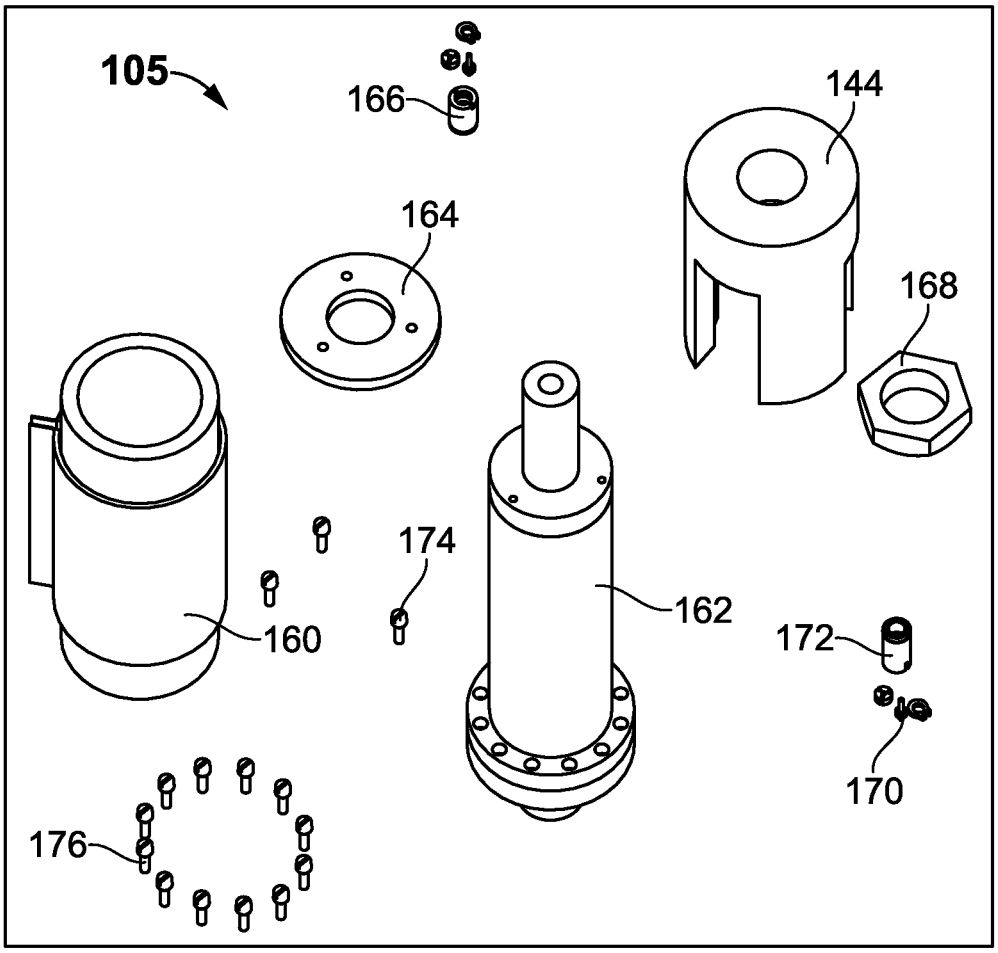
FIG. 11 exemplarily illustrates an exploded view of the evaporator, according to one embodiment of the present invention.
Figure 12:
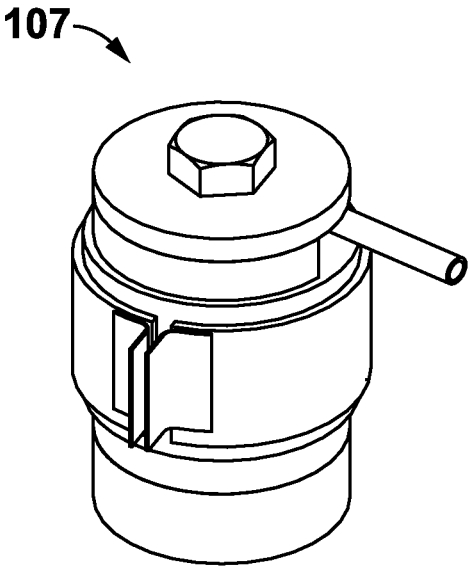
FIG. 12 exemplarily illustrates an isometric view of a super heater of the high-pressure instant steam generator, according to one embodiment of the present invention.
Figure 13:
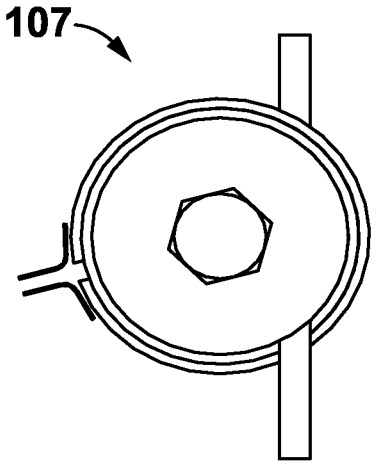
FIG. 13 exemplarily illustrates a sectional view of the super heater, according to one embodiment of the present invention.
Figure 14:
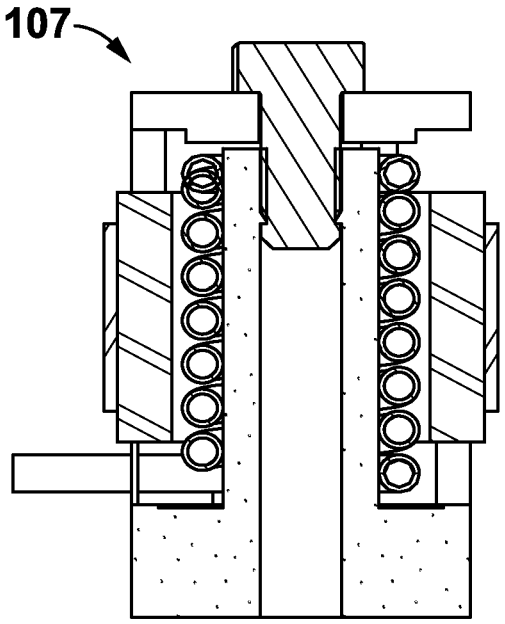
FIG. 14 exemplarily illustrates a front view of the super heater according to one embodiment of the present invention.
Figure 15:
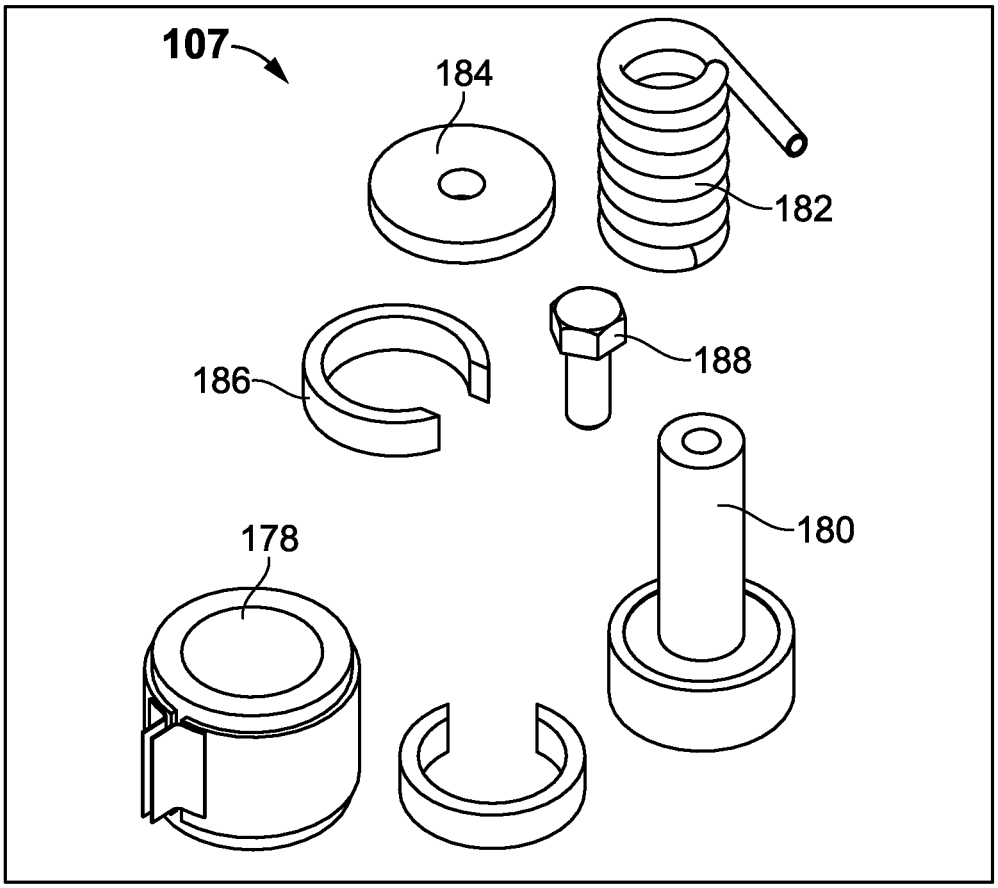
FIG. 15 exemplarily illustrates an exploded view of the super heater, according to one embodiment of the present invention.

Referring to FIGS. 1-3, a high-pressure instant steam generator (dependent unit), receives high pressure water from HPW. The high-pressure steam generator unit 100 instantaneously generate at high temperature to, for example, remove surface-level containments. In one embodiment, the steam generator unit 100 comprises a plurality of components include, but not limited to, a high-pressure unit 101, a high-pressure water band heater 103, an evaporator 105, a super heater 107, and at least a spray gun attachment 142 but may be any suitable high pressure steam delivery attachment.

In one embodiment, the high-pressure unit (HPW) 101 comprises a main pump 104 for supplying a liquid from a storage tank 102 at high pressure via at least one pressure relief valve 110, a flow regulator 112, and a diverter 114. In one embodiment, the high-pressure unit 101 further comprises a loop path or channel for preventing excess flow using a system relief valve 108 and a non-return valve 106, wherein the non-return valve 106 could avoid the flow to pass through this path when the pressure in the system relief valve 108 returns aside falls below suction pressure. In one embodiment, the flow from the main pump 104 has fixed displacement of about, but not limited to, max 1 GPM or 3.75 LPM.

In one embodiment, the high-pressure water band heater 103 is fluidly connected to the high-pressure unit 101 via a needle valve 116 and a first manifold 129 through a channel. In one embodiment, the high-pressure water band heater 103 is configured to heat the liquid supplied from the high-pressure unit 101. In one embodiment, at least one first pressure sensor 131 is securely inserted into the first manifold 129. The first pressure sensor 131 is configured to measure the pressure of the liquid and generate a current/voltage signal, which will send to a main control panel or a micro processing unit for further programming. In one embodiment, the needle valve 116 is configured to control the liquid flow.

In one embodiment, the evaporator 105 is fluidly connected to the high-pressure water band heater 103 having helical coils/water coil heater assembly 118 via a second manifold 122 and an inlet check valve 126 through the channel, wherein the evaporator 105 is configured to convert the liquid received from the high-pressure water band heater 103 into steam at a saturation point. In one embodiment, at least one hot water pressure sensor 120 and a temperature sensor 124 are securely inserted into the second manifold 122, wherein the hot water pressure sensor 120 is configured to measure pressure of the liquid flow and the temperature sensor 124 is configured to measure the temperature of the liquid. In one embodiment, the evaporator 105 could be positioned on an evaporator stand 144.

In one embodiment, the super heater 107 is fluidly connected to the evaporator 105 via an outlet check valve 127 and a third manifold 130 through the channel, wherein the super heater 107 having a super steam heater assembly 134 is configured to heat the generated steam to the saturated temperature. In one embodiment, at least one steam pressure sensor 128 and a steam temperature sensor 132 are securely inserted into the third manifold 130, wherein the steam pressure sensor 128 is configured to measure pressure of the steam and the steam temperature sensor 132 is configured to measure the temperature of the steam.

In one embodiment, the high-pressure steam attachment or spray gun 142 is fluidly connected to the super heater 107 via a fourth manifold 138 through the channel, wherein the high-pressure steam attachment or spray gun 142 is configured to enable the user to conveniently apply the generated high-pressure steam on the surfaces of the object, thereby effectively sanitizing and potentially removing surface-level containments. In one embodiment, the fourth manifold 138 is configured to receive at least one super heat steam pressure sensor 140 and a super heat temperature sensor 136, wherein the super heat steam pressure sensor 140 is configured to measure the pressure of the generated steam and the super heat temperature sensor 136 is configured to measure the temperature of the generated steam. In one embodiment, the plurality of components of the steam generator unit 100 could be mounted on a foundation plate 109 using copper/SS tubes, flexible tubes, a float switch, a breather, male stud couplings, and cheese screws. In one embodiment, the steam generator unit 100 further comprises an electrical control panel.

In one embodiment, the brief technical specification of the steam generator unit units (100 and 200) such as: maximum steam pressure is about 17 psi, maximum flow rate of water required for steam generation is about 30 grams/minute (~30 CC/minute), flow rate is adjustable up to 10 CC/minute, maximum pressure of steam generated is about 150 psi/200 psi, maximum temperature of super-heated steam is about 200 Deg C. to 250 Deg C., heating sources are band heaters, which are used to instant heating of water and super heating steam, and a specially designed evaporator. In one embodiment, the steam generator unit 100 could be a dependent system. Here dependent system means there is no separate storage tank and high-pressure pump. The system gets water required from the main high pressure washing system. High pressure water is fed directly to the first band heater. In another embodiment, the steam generator unit 100 could be an independent system. Here independent system means it has its own storage tank and high-pressure pump.

In one embodiment, the steam generator unit 100 is configured to instantaneously generate steam within 3 to 4 seconds. In an exemplary embodiment, the steam generator unit 100 is configured to instantaneously generate steam of 0.5 grams within 3 to 4 seconds. In theoretically the steam generator unit 100 generates steam of 0.5 grams within 0.85 seconds.

Referring to FIGS. 4-7, the high-pressure water band heater 103 of the steam generator unit 100 in one embodiment is disclosed. In one embodiment, the high-pressure water band heater 103 is configured to heat the liquid supplied from the high-pressure unit 101. In one embodiment, the construction details of the water band heater 103 comprises of, but not limited to, aluminum helical tubes of required size, co-axially aligned inside the band type heater. In one embodiment, the construction details of the water band heater 103 further comprises a water coil clamp 148, a water coil tube or helical tube 150, a heater spacer 152, a coil cap 154, and all these are secured using one or more fasteners 158, for example, a bolt. The band heater 103 is a purchase item of the required capacity. The band heater 103 is circular in section hallow inside where helical tubes carrying high pressure water pass through. In one embodiment, the band heater 103 length is selected depending on the heat required to raise the temperature water entering the heater to the saturations point at the pressure at which water enters the heater. In one embodiment, the band heater 103 is also equipped with a thermostat 146, so that once coil temperature reaches its maximum allowable limit the heater is switched off, thus heater 103 is protected from damage. Besides, in order to control pressure of water, a pressure sensor 131 (shown in FIG. 2) is inserted in the pipe line. This sensor 131 could be a purchase item. In one embodiment, the pressure sensor 131 not only measures the pressure, it also generates current/voltage signal, which will reach the main control panel/micro processing unit, for further programming.

In one embodiment, a proper clamping arrangement is made to secure the helical coil tube 150 to in position firmly. The heat from ceramic heater radiates on the helical coil 150 through which water flows. Besides the band heater 103 is contact with helical coils 150. Thus, heat is transmitted both by radiation and conduction on to water. The water coils 150 entering the heater, existing and also all related external parts are insulated to increase the efficiency of heater. By the time, water comes out of heater 103 it would have reached the saturations temperature. The entire assembly is proprietary item. The power of this unit is around, but not limited to, 400 watts to 500 watts.

Referring to FIGS. 8-11, the evaporator 105 of the steam generator unit 100 in one embodiment is disclosed. In one embodiment, the evaporator 105 is configured to convert the liquid received from the high-pressure water band heater 103 into steam at a saturation point. In one embodiment, the evaporator 105 comprises an evaporator chamber or a doubled walled vessel 162 having an inner vessel and an outer vessel encircled by a heater 160 of required capacity. This heater 160 is purchase item and is equipped with a thermostat. Before saturated water enter through pipes, its temperature is measured by a temperature sensor 120. The temperature sensor 120 is also capable of sending signal to the main control unit to be programmed. All parameters, pressure, temperature, etc.: are displayed on monitor placed in the control cabinet remotely. At the entry of evaporator 105, there is a check valve assembly 126, which avoids water flowing in reverse direction, in the event of pressure rise due to rise in temperature.

In one embodiment, the inner housing comprises at least three orifices, which are configured to force the liquid to the annular space between inner and outer vessel at a high velocity and causes the liquid to atomize thus the evaporation of the water is faster and at a higher efficiency. Thus, water is converted to steam without any rise change in temperature in the outer chamber. The outer chamber receives heat by radiation from the band heater, which is a purchase item. Now steam lives axially the evaporator, via a check valve 126, the purpose of the check valve 126 is to avoid steam flowing in reverse direction. The complete evaporator 105 is a proprietary item, specially designed for the purpose it is meant for. Then steam passes through insulated pipes in to the super heater. In the pipe line steam pressure is measured by the pressure sensor 128 (shown in FIG. 2). In one embodiment, the evaporator 105 further comprises an evaporator stand 144, a cover for inner vessel, a clamp plate 164, a high temperature seal, CV-M10 cartridge valve HSg outlet 166, Hex lock nut 168, a valve 170, CV-M10 cartridge HSG valve inlet 172, cheese screws (174 and 176), retaining ring, and a valve stopper. In one embodiment, the power of the evaporator 105 is around 1000 Watts to 1100 Watts.

Referring to FIGS. 12-15, the super heater 107 of the steam generator unit 100 in one embodiment is disclosed. In one embodiment, the super heater 107 is configured to heat the generated steam to the saturated temperature. In one embodiment, the super heater 107 could raise the temperature of steam from saturation point to 200 Deg C./around 50 Deg C. above the saturation point at the 200 psi pressure. In one embodiment, the super heater 107 comprises a band heater (250 W) 178, a clamp 180, a super heater coil tube 182, a coil tube cap 184, a heater spacer 186, and a bolt 188. The power is around 100 Watts to 150 watts. The heating coil 182 is helical and assembled concentric to band heater 178 that is circular, hollow. The steam is heated by radiation and by conduction. The heater coil 182 is secured in position by proper clamping. At the inlet of the super heater 107, a check valve 127 (shown in FIG. 2) is installed in line. The purpose of the check valve 127 is to avoid the flow of steam in reverse direction. As the super-heated steam exists its temperature is measured by a separate sensor 128. At the outlet of super heater, a temperature sensor is fixed in the line. This will measure the temperature. Besides it provides signal to control unit, so that at the event of any increase in temperature, the heater is switched ON and automatically starts when the temperature falls below the set level. This will work like a differential sensor gage. It will have to cut off point one when temperature rising to higher limit of temperature. The other cut off point when temperature is falling to lower limit. The difference in these two ranges is between 5 Deg C. to 8 Deg C.

Figure 16:
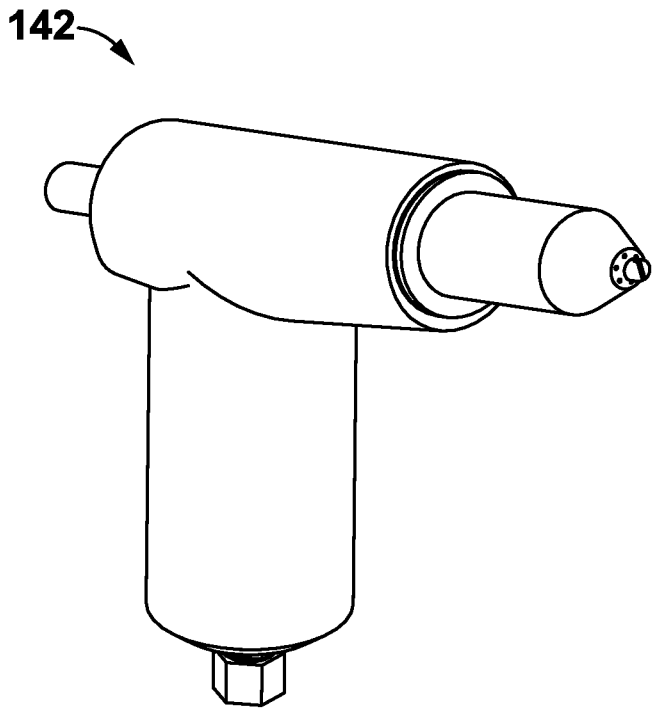
FIG. 16 exemplarily illustrates an isometric view of high-pressure an example spray gun attachment of the high-pressure instant steam generator, according to one embodiment of the present invention.
Figure 17:
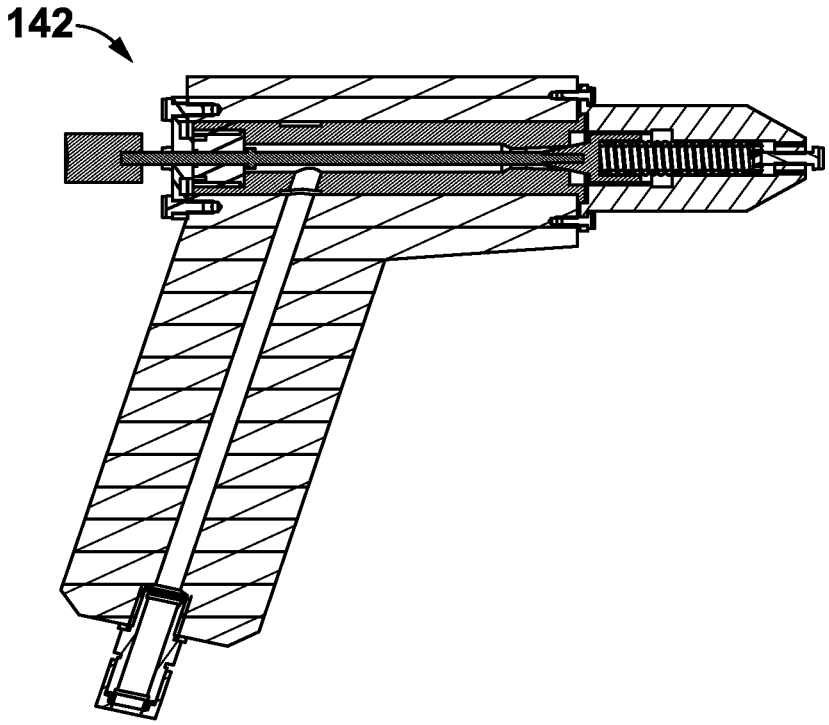
FIG. 17 exemplarily illustrates a sectional view of the example spray gun attachment, according to one embodiment of the present invention.
Figure 18:
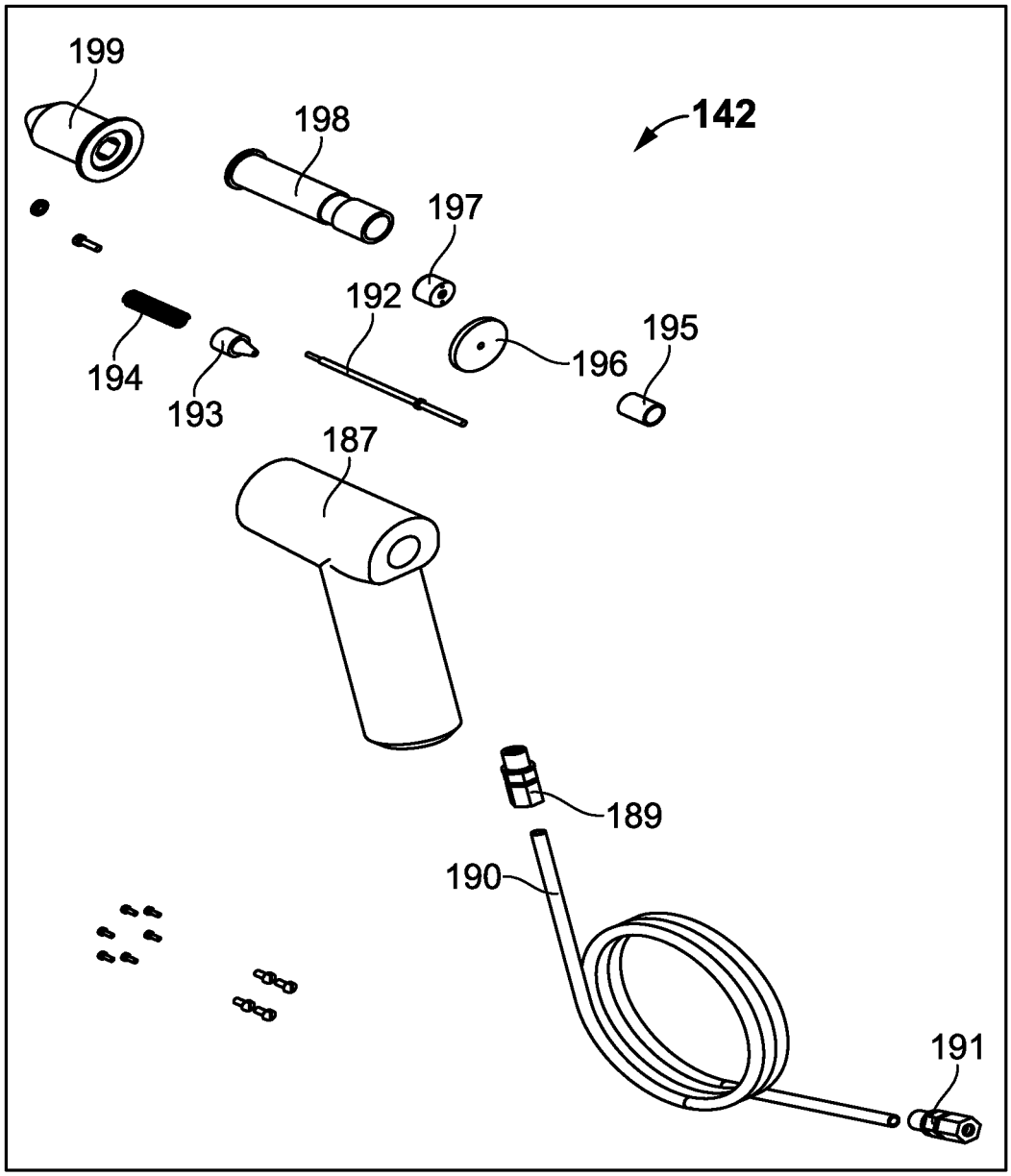
FIG. 18 exemplarily illustrates an exploded view of the example spray gun attachment, according to one embodiment of the present invention.

Referring to FIGS. 16-18, the high-pressure steam attachment or spray gun 142 of the steam generator unit 100 is disclosed. In one embodiment, the high-pressure steam attachment or spray gun 142 is configured to enable the user to conveniently apply the generated high-pressure steam on the surfaces of the object, thereby effectively sanitizing and potentially removing surface-level containments. Superheated steam, at the set pressure, enters the high-pressure steam attachment or spray gun 142 through a hose pipe 190 of sufficient length, normally around 2 to 3 meters. It needless to say, that hoses 190 are well insulated to avoid any drop in temperature, pressure and also to avoid condensation. The housing of high-pressure steam attachment or spray gun 142 is nonmetallic, having a very good insulation property. It is in the shape of a gun, and hence the name. The high-pressure steam attachment or spray gun 142 is handheld for spraying/applying steam on the object which is to be cleaned. The high pressure and superheated steam enter the high-pressure steam attachment or spray gun 142 from the stud coupling 189. The steam passes through steam entry tube 198. This entry tube 198 could be metallic, embedded in plastic outer case 187 and then passes through nozzle housing 199. In one embodiment, the nozzle housing 199 could be fitted to the high-pressure steam attachment or spray gun attachment handle 187 by fixing bolts with proper sealing to avoid leakage of steam. The nozzle housing houses a few parts, co-axial to it with proper sealing to avoid leakage. The others parts are, nozzle valve 193, valve actuator spring 194, spring adjuster washer, and seal nut. These are the parts to control steam velocity and also to adjust steam pressure. Normally, the nozzle valve 193 is closed by actuator spring 194, so long as the pressure is within the set valve. The valve will open once the steam pressure exceeds the set value. This is because the steam pressure exceeds spring force. In one embodiment, the high-pressure steam attachment or spray gun attachment assembly further comprises a male and female coupling fit 191, M2 and M3 screws, a cover 196, and seal nuts with high temperature seals to avoid stream leakage 197.

The pressure controller 192 is a long pin, which presses the nozzle valve 193, which is normally held closed due to spring 194 force. Thus, the valve 193 is opened allowing steam to pass through spring adjust washer. The washer has slots on its periphery. Then steam passes through annular holes in the nozzle housing on its face. The passage of steam is opened by pressing the knob 195, which in turn pushes the pressure controller 192. Proper high pressure, high temperature seals are provided wherever required, to avoid leakage of steam. The required pressure adjustment or reduce blowing pressure from about 175 psi to 150 psi. In such case, the user needs to un-screw the pressure adjuster. The value could be read on the digital display monitor. The user could increase pressure using the pressure adjuster. By doing so you are varying spring force.

Figure 19:
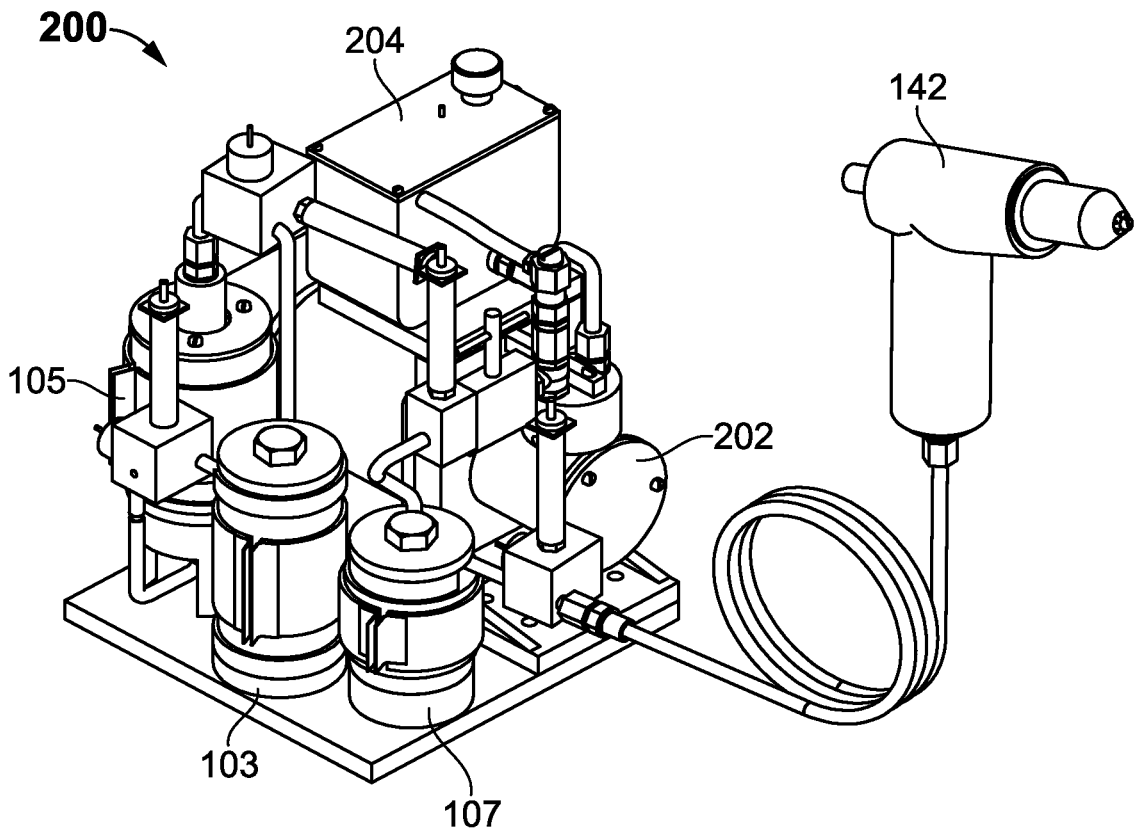
FIG. 19 exemplarily illustrates a perspective view of a high-pressure instant steam generator, which acts an independent system, which is acts an independent system, according to another embodiment of the present invention.
Figure 20:
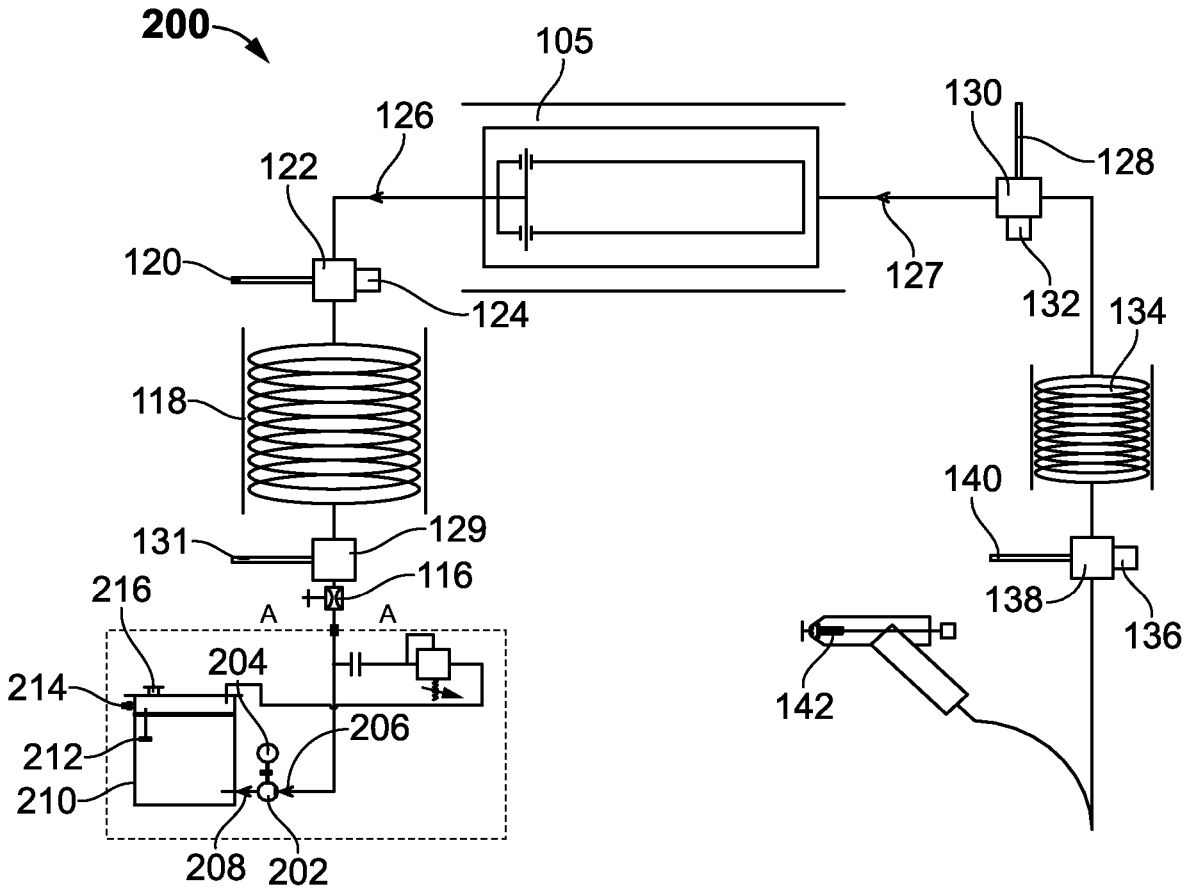
FIG. 20 exemplarily illustrates a block diagram of the high-pressure instant steam generator (independent system), according to one embodiment of the present invention.

Referring to FIGS. 19-20, a high-pressure instant steam generator 200 acts as an independent system according to another embodiment is disclosed. In another embodiment, the steam generator unit 200 comprises a micro-pump and motor assembly instead of connected to the diverter valve. In one embodiment, the steam generator unit 200 comprises a micro pump 202 with a motor assembly and an expansion vessel 204 for supplying a liquid from a storage tank 210 at high pressure, wherein the storage tank 210 comprises a level switch 212, a filter low level indicator 214, a breather 216, and an over flow pipe. The pressure it can develop is in the order of about, but not limited to, 200 psi-250 psi. The maximum flow is 30 cc/minute. The assembly has its own small tank which is similar to a fish tank capacity has a capacity of about 8 liters/5 liters. In one embodiment, the storage tank 210 is of PVC construction.

In one embodiment, the steam generator unit 200 is an independent unit, to produce high pressure water. In one embodiment, the expansion vessel is a light PVC construction, or any such material moulded tank has a capacity of 8 to 5 Liters. The expansion vessel temporarily holds a small amount of water ready to use for steam generation. The flow is automatic through non-return valve to the barrel of micro pump when motor is working. The motor on and off is control remotely from the electrical control panel and the control panel is placed in a convenient position, wherein all the control is electrical except the flow control by needle valve. In one embodiment, the controls of the steam generator unit (100 and 200) are remotely housed and comprise a microprocessor unit, so that the sequence of operation can be programmed.

In another embodiment, the steam generator unit 200 acts an independent system, which is a cleaning system on its own. The high-pressure water of required flow 30 cc/minute is supplied by a micro pump 202. The micro pump 202 draws water from miniature tank 210, which is similar to fish tank used in house aquarium. In one embodiment, the steam generator unit 200 has its own related valves, control flow, pressure, and also sensors of pressure and temperature. The sensors will provide signals to operate the unit from a microprocessor or from electrical control units remotely. It is necessary to read the PID diagram/steam circuit as shown in FIG. 2, to understand the design, function and construction of the independent system. The water from needle valve 116 flows through the first band heater 103 to raise temperature to saturation point at that pressure (i.e., 150 psi/200 psi). At this point, it is necessary to mention that the required pressure is controlled in the high-pressure washing system. There is not separate pressure control valve here. In the next stage, the saturated water enters to the evaporator 105 where it is converted to steam at that pressure. That is only latent heat is added. Evaporator 105 is heated by band heater 103. Then saturated enters the super heater where is temperature is raised to 200 to 250 Deg C. before entering the spray nozzle 142. It may be noted, water/steam path is not reversible, which means there is no back flow. The entire water path and steam path are equipped with pressure and temperature sensors.

Figure 21:
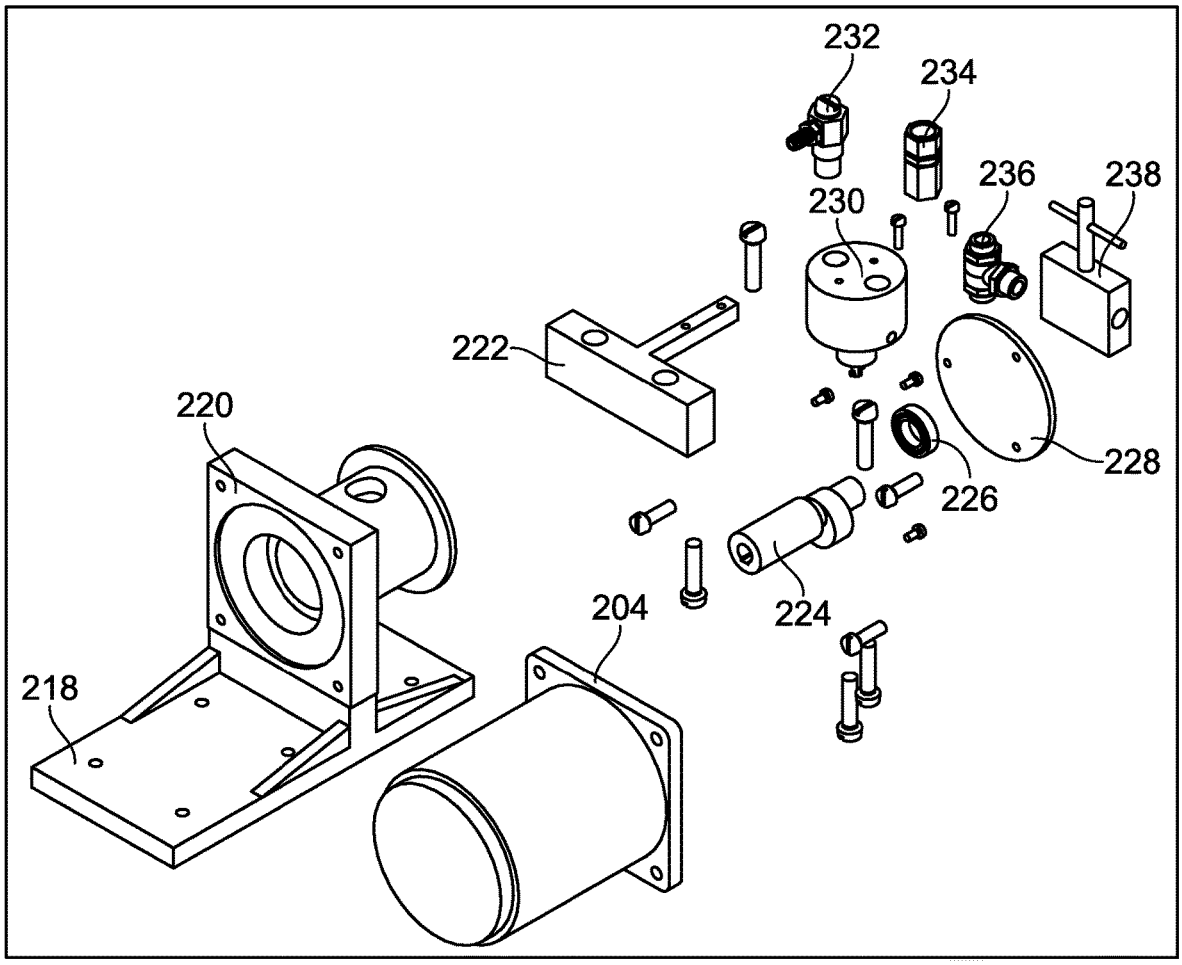
FIG. 21 exemplarily illustrates an exploded view of a motor assembly of the high-pressure instant steam generator (independent system), according to one embodiment of the present invention.

Referring to FIG. 21, a motor assembly 204 of the steam generator unit 200 in one embodiment is disclosed. In one embodiment, the motor 204 could be a single phase 220 V electrical motor of RPM 1500 and power 75 Watts is used to drive the pump. This is a constant RPM Motor. In one embodiment, the motor assembly comprises a footing and a motor bracket (218 and 220), AC motor (220 V, 50 Hz, 20 W) 204, a pump clamp 222, pump drive eccentric shaft 224, a bearing (SKF 61801 2RSI) 226, a bearing cover 228, a piston pump assembly 230, RF valve assembly 232, swivel nut assembly 234, T-assembly 236, needle valve ⅛ BSP (M10), cheese screws, etc.

Figure 22:
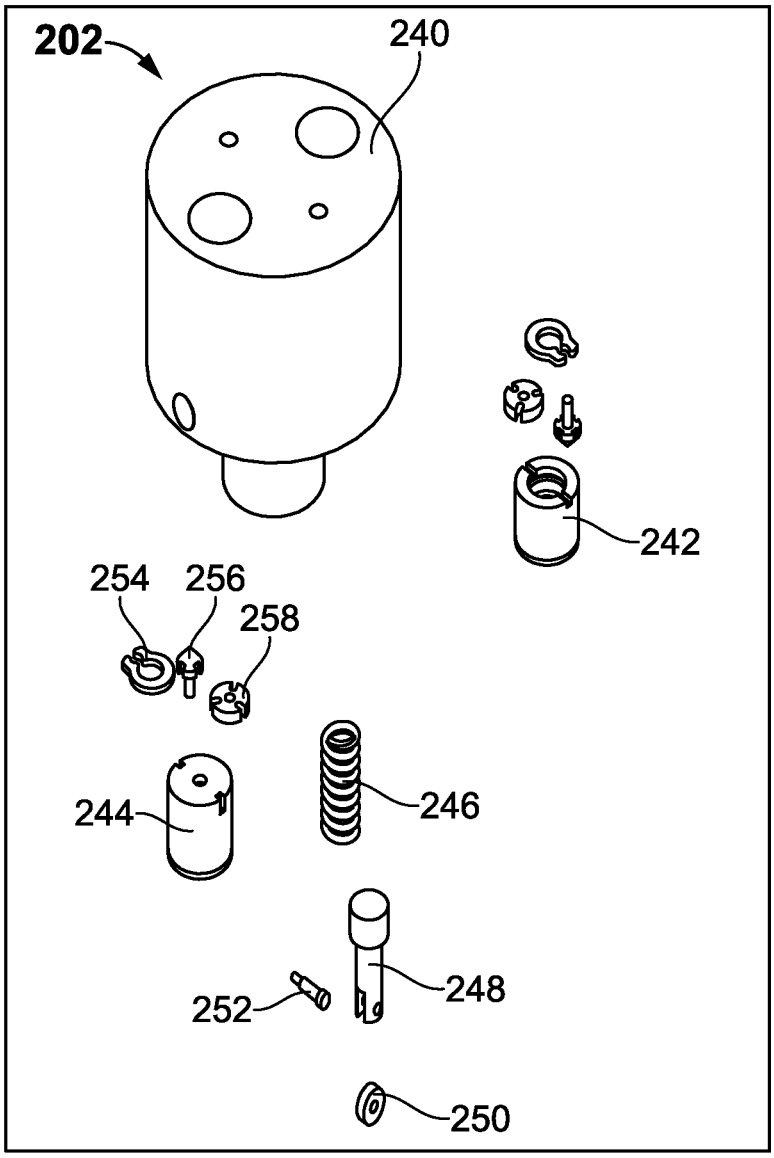
FIG. 22 exemplarily illustrates an exploded view of a micro pump assembly of the high-pressure instant steam generator (independent system), according to one embodiment of the present invention.

Referring to FIG. 22, the micro pump assembly 202 of the steam generator unit 200 in one embodiment is disclosed. In one embodiment, the micro pump 202 is a small piston pump of flow of about 0.11 cc/revolutions. The micro pump 202 is designed to run at 1500 RPM. The micro pump 202 piston reciprocates by an eccentric shaft, which is driven by the motor 204. There is a restoring spring 246 to restore the position of piston 248. The pump has inlet and outlet valves (242 and 244). The inlet valve 242 opens inward to allow the water to flow inside. The outlet valve 244 opens outward to allow water flow outside. Since flow is less, the estimated volumetric efficiency is around 75% to 80% and mechanical efficiency is around 75% to 80%. The power consumed is around 75 Watts. The pump flow is directed to a needle valve 238 (shown in FIG. 21) by which we can reduce and increase flow to a minimum of 0 and maximum of 30 CC/minute. The needle valve 238 is the purchase item. After needle valve 238 upstream all parts are same as the steam generator unit 100 shown in FIG. 1.

Figure 23:
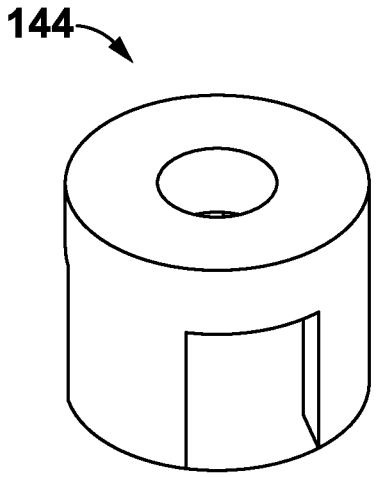
FIG. 23 exemplarily illustrates a perspective view of an evaporator stand for the high-pressure instant steam generator (independent system), according to one embodiment of the present invention.
Figure 24:
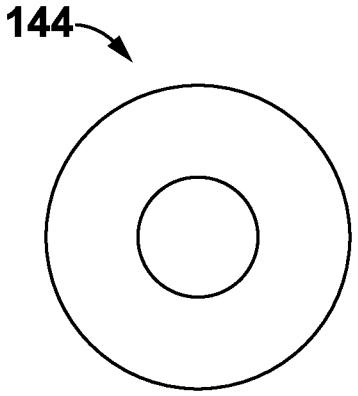
FIG. 24 exemplarily illustrates a side view of the evaporator stand, according to one embodiment of the present invention.
Figure 25:
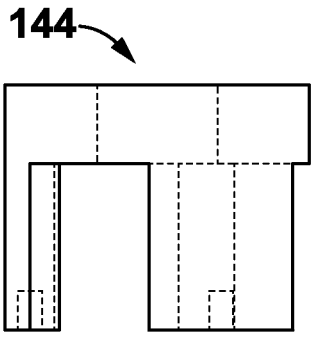
FIG. 25 exemplarily illustrates a top view of the evaporator stand, according to one embodiment of the present invention.

Referring to FIGS. 23-25, the evaporator stand 144 of the steam generator unit 100 in one embodiment is disclosed. In one embodiment, the evaporator stand 144 is configured to support the evaporator 105. In one embodiment, the evaporator stand 144 is securely connected to the foundation plate 109 (shown in FIG. 3) using one or more fasteners.

Figure 26:
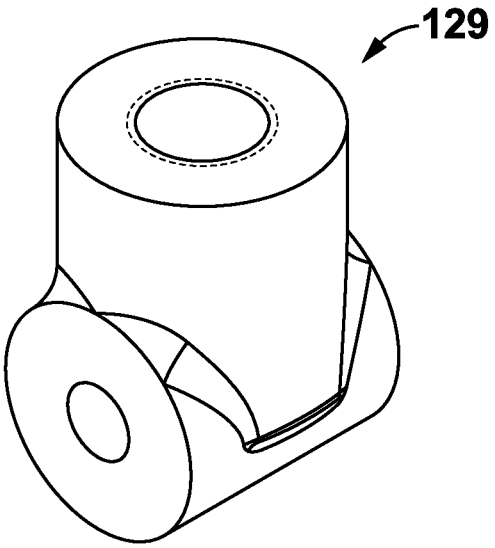
FIG. 26 exemplarily illustrates a perspective view of a first manifold, according to one embodiment of the present invention.
Figure 27:
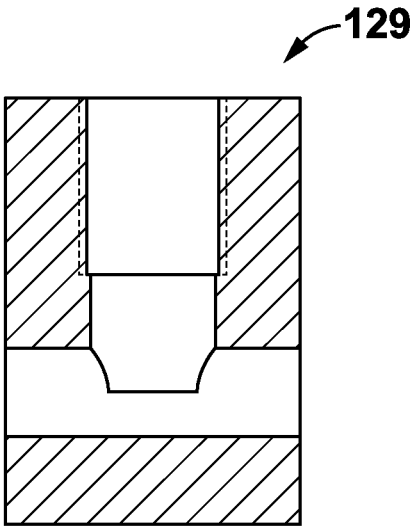
FIG. 27 exemplarily illustrates a sectional view of the first manifold, according to one embodiment of the present invention.

Referring to FIGS. 26-27, the first manifold 129 of the steam generator unit 100 in one embodiment is disclosed. In one embodiment, the first manifold 129 is configured to receive at least one first pressure sensor 131. The first pressure sensor 131 is configured to measure the pressure of the liquid and generate a current/voltage signal, which will send to a main control panel or a micro processing unit for further programming. In one embodiment, the first manifold 129 comprises an opening or an aperture for receiving the pressure sensor 131.

Figure 28:
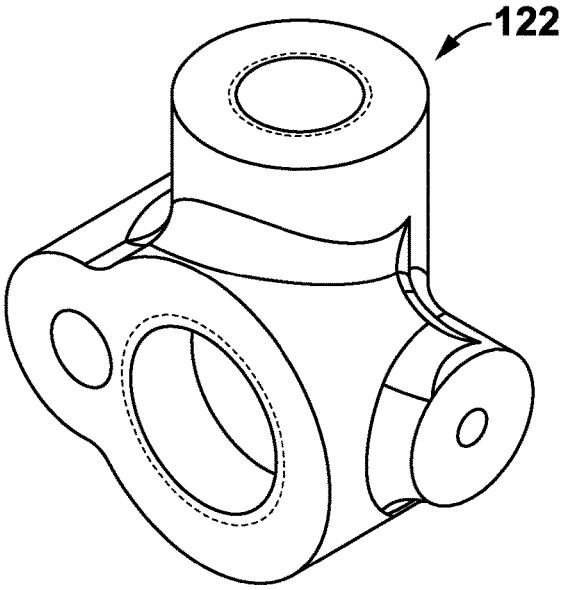
FIG. 28 exemplarily illustrates a perspective view of a second manifold, according to one embodiment of the present invention.
Figure 29:
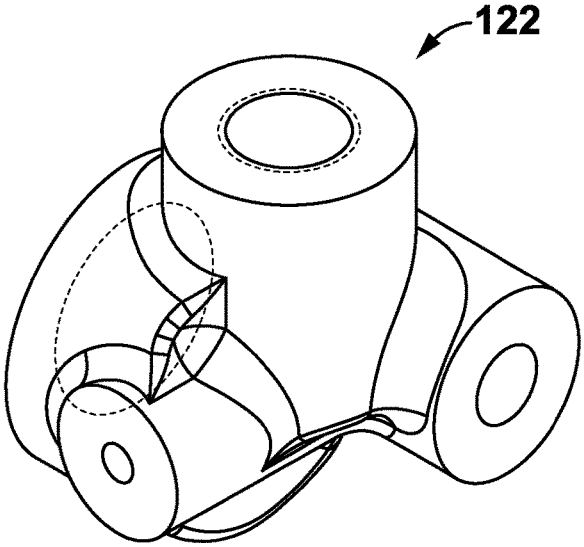
FIG. 29 exemplarily illustrates a top perspective view of the second manifold, according to one embodiment of the present invention.
Figure 30:
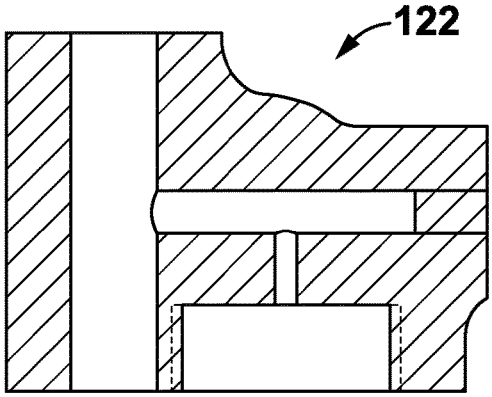
FIG. 30 exemplarily illustrates a sectional view of the second manifold, according to one embodiment of the present invention.

Referring to FIGS. 28-30, the second manifold 122 of the steam generator unit 100 in one embodiment is disclosed. In one embodiment, the second manifold 122 is configured to receive at least one hot water pressure sensor 120 and a temperature sensor 124. The hot water pressure sensor 120 is configured to measure pressure of the liquid flow and the temperature sensor 124 is configured to measure the temperature of the liquid. In one embodiment, the second manifold 122 comprises openings or apertures for receiving the hot water pressure sensor 120 and the temperature sensor 124.

Figure 31:
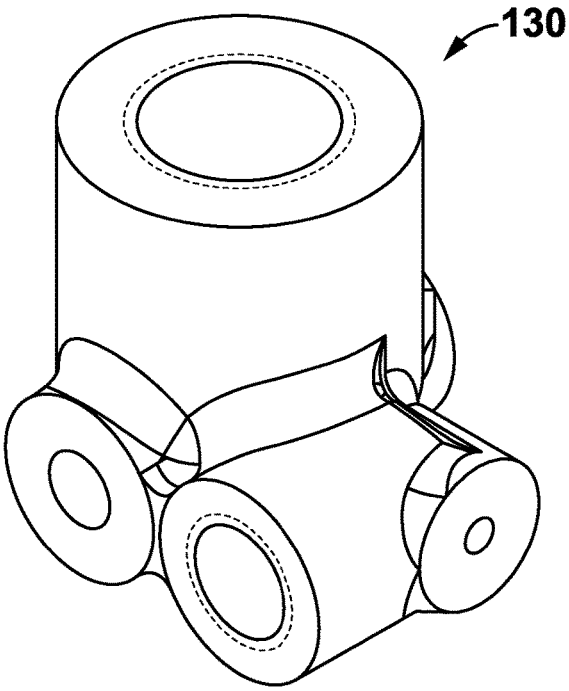
FIG. 31 exemplarily illustrates a perspective view of a third manifold, according to one embodiment of the present invention.
Figure 32:
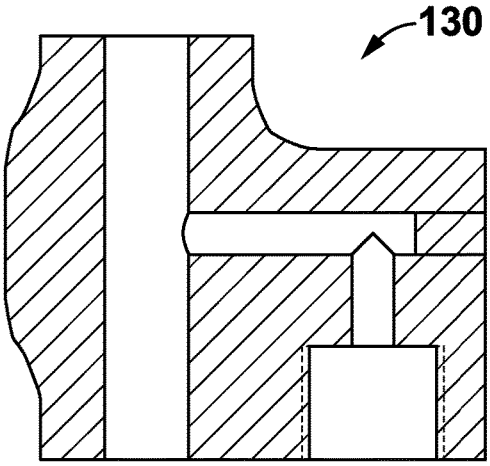
FIG. 32 exemplarily illustrates a sectional view of the third manifold, according to one embodiment of the present invention.
Figure 33:
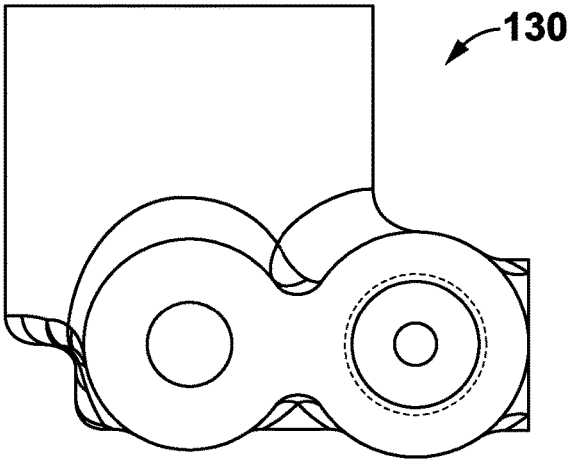
FIG. 33 exemplarily illustrates a side view of the third manifold, according to one embodiment of the present invention.

Referring to FIGS. 31-33, the third manifold 130 of the steam generator unit 100 in one embodiment is disclosed. In one embodiment, the third manifold 130 is configured to receive at least one steam pressure sensor 128 and a steam temperature sensor 132. The steam pressure sensor 128 is configured to measure pressure of the steam and the steam temperature sensor 132 is configured to measure the temperature of the steam. In one embodiment, the third manifold 130 comprises openings or apertures for receiving the steam pressure sensor 128 and a steam temperature sensor 132.

Figure 34:
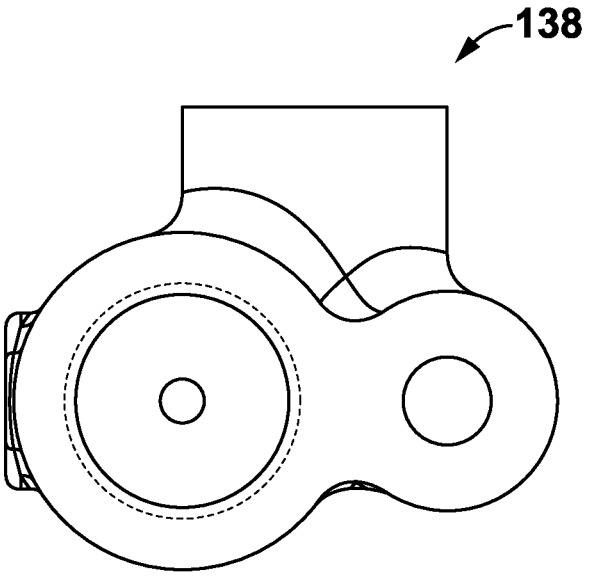
FIG. 34 exemplarily illustrates a side view of a fourth manifold, according to one embodiment of the present invention.
Figure 35:
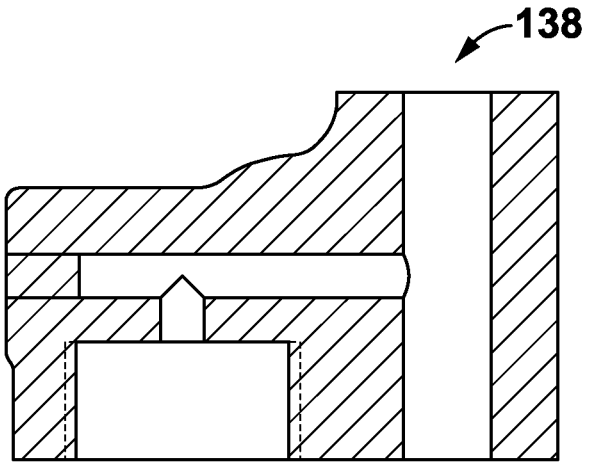
FIG. 35 exemplarily illustrates a sectional view of the fourth manifold, according to one embodiment of the present invention.

Referring to FIGS. 34-35, the fourth manifold 138 of the steam generator unit 100 in one embodiment is disclosed. In one embodiment, the fourth manifold 138 is configured to receive at least one super heat steam pressure sensor 140 and a super heat temperature sensor 136, wherein the super heat steam pressure sensor 140 is configured to measure the pressure of the generated steam and the super heat temperature sensor 136 is configured to measure the temperature of the generated steam. In one embodiment, the fourth manifold 138 comprises openings or apertures for receiving the super heat steam pressure sensor 140 and the super heat temperature sensor 136.

Preferred embodiments of this innovation are described herein, including the best mode known to the inventors for carrying out the innovation. It should be understood that the illustrated embodiments are exemplary only and should not be taken as limiting the scope of the innovation.

The foregoing description comprises illustrative embodiments of the present innovation. Having thus described exemplary embodiments of the present innovation, it should be noted by those skilled in the art that the within disclosures are exemplary only, and that various other alternatives, adaptations, and modifications may be made within the scope of the present innovation. Merely listing or numbering the steps of a method in a certain order does not constitute any limitation on the order of the steps of that method. Many modifications and other embodiments of the innovation will come to mind to one skilled in the art to which this innovation pertains having the benefit of the teachings in the foregoing descriptions. Although specific terms may be employed herein, they are used only in generic and descriptive sense and not for purposes of limitation. Accordingly, the present innovation is not limited to the specific embodiments illustrated herein.

What is claimed is:

1. A high-pressure instant steam generator acts as a dependent system, comprising:

a high-pressure unit comprises a main pump for supplying a liquid from a storage tank or water hose at high pressure via at least one pressure relief valve, a flow regulator, and a diverter;

a high-pressure water band heater fluidly connected to the high-pressure unit via a needle valve and a first manifold through a channel, configured to heat the liquid supplied from the high-pressure unit;

an evaporator fluidly connected to the high-pressure water band heater via a second manifold and an inlet check valve through the channel, wherein the evaporator is configured to convert the liquid received from the high-pressure water band heater into steam at a saturation point;

a super heater fluidly connected to the evaporator via an outlet check valve and a third manifold through the channel, wherein the super heater is configured to heat the generated steam to the saturated temperature, and a high-pressure steam attachment or spray gun fluidly connected to the super heater via a fourth manifold through the channel, wherein the high-pressure steam attachment or spray gun is configured to enable the user to conveniently apply the generated high-pressure steam on the surfaces of the object, thereby effectively sanitizing and potentially removing surface-level containments.

2. The high-pressure instant steam generator of claim 1, wherein the high-pressure water band heater further comprising a hollow section, one or more helical coils or tubes disposed within the hollow section, wherein the helical coils are configured to allow high pressure water;

a heater configured to radiate on the helical coils through which liquid flows for heating the liquid, and a thermostat configured to protect the heater from damages by switching off when the temperature reaches its maximum allowable limit.

3. The high-pressure instant steam generator of claim 1, wherein the helical tubes are made of a material includes copper, steel, and aluminum.

4. The high-pressure instant steam generator of claim 1, wherein the high-pressure water band heater length is selected depending on the heat required to raise the temperature water entering the heater to the saturations point at the pressure at which water enters the heater.

5. The high-pressure instant steam generator of claim 1, wherein the needle valve is configured to control the liquid flow.

6. The high-pressure instant steam generator of claim 1, wherein the first manifold is configured to receive at least one first pressure sensor, wherein the first pressure sensor is configured to measure the pressure of the liquid and generate a current/voltage signal, which will send to the main control panel or a micro processing unit for further programming.

7. The high-pressure instant steam generator of claim 1, wherein the second manifold is configured to receive at least one hot water pressure sensor and a temperature sensor, wherein the hot water pressure sensor is configured to measure pressure of the liquid flow and the temperature sensor is configured to measure the temperature of the liquid.

8. The high-pressure instant steam generator of claim 1, wherein the third manifold is configured to receive at least one steam pressure sensor and a steam temperature sensor, wherein the steam pressure sensor is configured to measure pressure of the steam and the steam temperature sensor is configured to measure the temperature of the steam.

9. The high-pressure instant steam generator of claim 1, wherein the fourth manifold is configured to receive at least one super heat steam pressure sensor and a super heat temperature sensor, wherein the super heat steam pressure sensor is configured to measure the pressure of the generated steam and the super heat temperature sensor is configured to measure the temperature of the generated steam.

10. The high-pressure instant steam generator of claim 1, wherein the evaporator further comprising:

an evaporator chamber or a doubled walled vessel having an inner housing and an outer housing, wherein the inner housing comprises at least three orifices, which are configured to force the liquid to the annular space between inner and outer vessel at a high velocity and causes the liquid to atomize thus the evaporation of the water is faster and at a higher efficiency.

11. A high-pressure instant steam generator acts as an independent system, comprising:

a micro pump with a motor assembly for supplying a liquid from a storage tank or water hose at high pressure, wherein the storage tank comprises a level switch, a filter low level indicator, and an over flow pipe;

a high-pressure water band heater fluidly connected to the micro pump with a motor assembly via a needle valve and a first manifold through a channel, configured to heat the liquid supplied from the high-pressure unit, wherein the needle valve is configured to control the liquid flow;

an evaporator fluidly connected to the high-pressure water band heater via a second manifold and an inlet check valve through the channel, wherein the evaporator is configured to convert the liquid received from the high-pressure water band heater into steam at a saturation point;

a super heater fluidly connected to the evaporator via an outlet check valve and a third manifold through the channel, wherein the super heater is configured to heat the generated steam to the saturated temperature, and a high-pressure steam attachment or spray gun fluidly connected to the super heater via a fourth manifold through the channel, wherein the high-pressure steam attachment or spray gun is configured to enable the user to conveniently spray or apply the generated high-pressure steam on the surfaces of the object, thereby effectively sanitizing and potentially removing surface-level containments.

12. The high-pressure instant steam generator of claim 11, wherein the micro pump is a fixed-displacement pump.

13. The high-pressure instant steam generator of claim 11, wherein the high-pressure water band heater further comprising a hollow section, one or more helical coils or tubes disposed within the hollow section, wherein the helical coils are configured to allow high pressure water;

a heater configured to radiate on the helical coils through which liquid flows for heating the liquid, and a thermostat configured to protect the heater from damages by switching off when the temperature reaches its maximum allowable limit.

14. The high-pressure instant steam generator of claim 11, wherein the helical tubes are made of a material includes copper, steel, and aluminum.

15. The high-pressure instant steam generator of claim 11, wherein the high-pressure water band heater length is selected depending on the heat required to raise the temperature water entering the heater to the saturations point at the pressure at which water enters the heater.

16. The high-pressure instant steam generator of claim 11, wherein the first manifold is configured to receive at least one first pressure sensor, wherein the first pressure sensor is configured to measure the pressure of the liquid and generate a current/voltage signal, which will send to the main control panel or a micro processing unit for further programming.

17. The high-pressure instant steam generator of claim 11, wherein the second manifold is configured to receive at least one hot water pressure sensor and a temperature sensor, wherein the hot water pressure sensor is configured to measure pressure of the liquid flow and the temperature sensor is configured to measure the temperature of the liquid.

18. The high-pressure instant steam generator of claim 11, wherein the third manifold is configured to receive at least one steam pressure sensor and a steam temperature sensor, wherein the steam pressure sensor is configured to measure pressure of the steam and the steam temperature sensor is configured to measure the temperature of the steam.

19. The high-pressure instant steam generator of claim 11, wherein the fourth manifold is configured to receive at least one super heat steam pressure sensor and a super heat temperature sensor, wherein the super heat steam pressure sensor is configured to measure the pressure of the generated steam and the super heat temperature sensor is configured to measure the temperature of the generated steam.

20. The high-pressure instant steam generator of claim 11, wherein the evaporator further comprising:

an evaporator chamber or a doubled walled vessel having an inner housing and an outer housing, wherein the inner house comprises at least three orifices, which are configured to force the liquid to the annular space between inner and outer vessel at a high velocity and causes the liquid to atomize thus the evaporation of the water is faster and at a higher efficiency.

* * * * *